United States Patent [19]

Toman

[11] Patent Number: 4,523,533

[45] **Date of Patent: * Jun. 18, 1985**

[54] FORCE TRANSFER MEANS

[75] Inventor: George M. Toman, Chicago, Ill.

[73] Assignee: Union Special Corporation, Chicago, Ill.

[ * ] Notice: The portion of the term of this patent subsequent to Feb. 22, 2000 has been disclaimed.

[21] Appl. No.: 386,366

[22] Filed: Jun. 8, 1982

Related U.S. Application Data

[63] Continuation of Ser. No. 904,203, May 9, 1978, abandoned.

[51] Int. Cl.[3] ..... D05B 57/32

[52] U.S. Cl. ..... 112/199; 112/220; 74/52

[58] Field of Search ..... 74/52; 112/55, 199, 112/200, 201, 220, 221

[56] References Cited

U.S. PATENT DOCUMENTS

| | | | |
|---|---|---|---|
| 2,193,344 | 3/1940 | Reece | 74/52 |
| 2,667,135 | 1/1954 | Bell | 112/245 |
| 2,676,799 | 4/1954 | Fletcher | 74/52 X |
| 2,760,457 | 8/1956 | Rabezzana | 112/221 |
| 3,318,274 | 5/1967 | Schoij | 112/248 |
| 4,022,140 | 5/1977 | Lienemann | 112/199 |
| 4,344,376 | 8/1982 | Bhatia et al. | 112/200 |
| 4,362,113 | 12/1982 | Bock et al. | 112/199 |
| 4,374,502 | 2/1983 | Toman et al. | 112/199 X |

OTHER PUBLICATIONS

Product Engineering, 9/28/59, pp. 66, 67.

*Primary Examiner*—Wm. Carter Reynolds
*Attorney, Agent, or Firm*—John W. Harbst; John A. Schaerli

[57] ABSTRACT

A force transfer assembly connects the output centerpoint of a Cardan gear mechanism to a work performing assembly. The motion of the output centerpoint moving in a first and second plane is translated by the force transfer assembly such that the work performing assembly moves in first, second and third planes. The force transfer assembly preferably includes a rotatable spherical element carried by the output lever of the Cardan gear mechanism, with a slider pin journalled in the spherical element and connected to the work performing assembly.

6 Claims, 9 Drawing Figures

34
22
80
82
32
36
40
44
50
51
52
46
48
106
104
110
108
128
142
147
B
X
Y
Z
100
101
107
109
9

FORCE TRANSFER MEANS

This is a continuation of application Ser. No. 904,203 filed May 9, 1978, now abandoned.

This invention relates to a force transfer means having a substantial number of degrees of freedom. It is more particularly related to a force transfer means employed to transfer force from the output lever of a Cardan gear type means to a work performing instrumentality.

It is well known that the output centerpoint of a Cardan gear type means can be adjusted such that rather than sweeping out a straight line, it sweeps out an ellipse. It is also well known that particular elements employed in forming a Class 400 type stitch also sweep out elliptical like paths. The tip of the looper, for example, employed in the formation of a Class 401 type stitch sweeps out an ellipse having a major and minor axis.

For various reasons it is not practical to secure the looper means directly to the output pinion shaft of the Cardan gear type assembly. The driving of the Cardan gear module itself would create additional problems since the orientation of the module would be dictated by the direction in which the looper was driven. These factors would in turn dictate the overall designs of the sewing machine to the extent that it would prove impractical. It has also been found that the looper assembly and the Cardan gear assembly cannot simply be redesigned to overcome these problems. A conduit, it was discovered, was needed between the Cardan gear driving means and the work performing means which allowed independence of location yet allowed force to be transmitted. The problems of force transfer become ever more complex when a Cardan gear assembly is employed to drive the upper looper in the formation of a Class 504 stitch where the looper tip sweeps out a helix. The force transfer means hereunder consideration conducts variable amounts of rotational and translational force to a work performing means, for example, a looper means.

In accordance with the invention here under consideration a force transfer means is provided between the output means of a Cardan gear module and the work performing instrumentality. In a preferred embodiment a ball and socket is employed with the ball having a sliding pin passing therethrough. As a result, motion of the output lever can be transferred to the work performing element such that its output can take any of a series of different paths. A force transfer means of this nature provides a cure for problems such as misalignment of elements during fabrication or assembly. Three elements are involved in the force transfer means hereunder consideration: a journal means (slider pin); a floating element (ball); and bearing (socket).

The ball means floats between the slider pin and the socket. This allows at least two beneficial results: first the ball is allowed to rotate at some velocity less than the socket thus the sliding velocity is shared between two surfaces; second, there is a safety factor in that one bearing surface can lock up and the other surface can carry the load for a short period of time without destruction of the assembly.

It is therefore an object of this invention to provide a force transfer means which transfers variable amounts of both translational and rotational movement. It is yet another object of this invention to provide a Cardan gear means for driving a work performing means through a curve where a force transfer means is interposed therebetween. Still another object of this invention is to provide a ball and socket having a round pin, for translating rotational and translational movement, which constitutes a full floating bearing. But another object of this invention is to provide a force transfer means which conducts force between a Cardan gear means and a work performing means while allowing degrees of freedom in the actual relationship of these elements to each other. It is still another object of this invention to provide a force transfer means connecting a Cardan gear means and a work performing means which accepts force in two degrees of freedom and provides an output in three degrees of freedom.

Other features and advantages of the invention will appear from the detailed description of a preferred embodiment of the same which will now be given in conjunction with the accompanying drawings in which.

Figure 1:
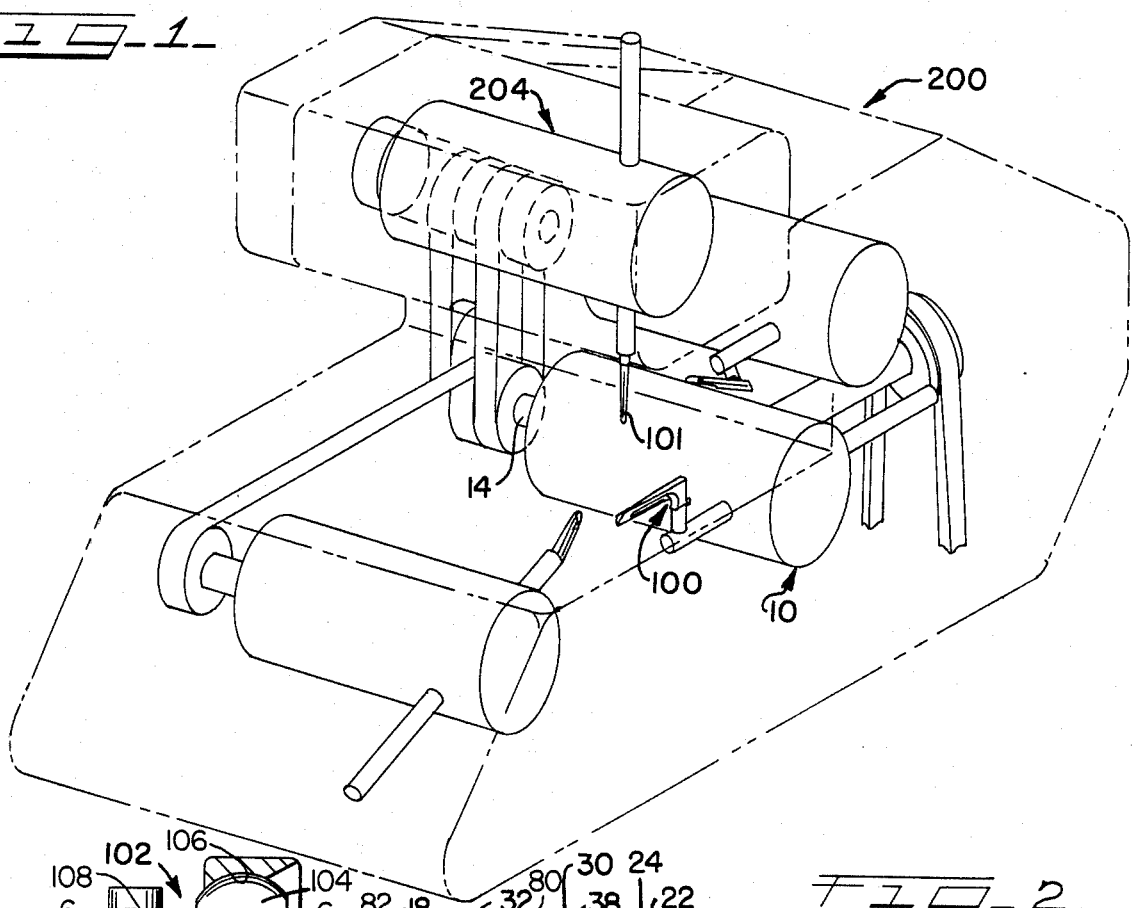
FIG. 1 is a partial isometric view of a sewing machine wherein the looper and related stitch forming elements are driven by Cardan gear type modules.

Referring now to the above mentioned drawings and particularly to FIG. 1 which shows features of the present invention applied to a stylized sewing machine 200. A series of Cardan gear modules are employed to drive a series of elements which cooperate to form, for example, a 401 stitch. These elements include a lower looper Cardan gear module 10 and a needle Cardan gear module 204. The needle means 101 cooperate with the looper means 100 in a well known manner to form the standard class 401 stitch.

Figure 2:
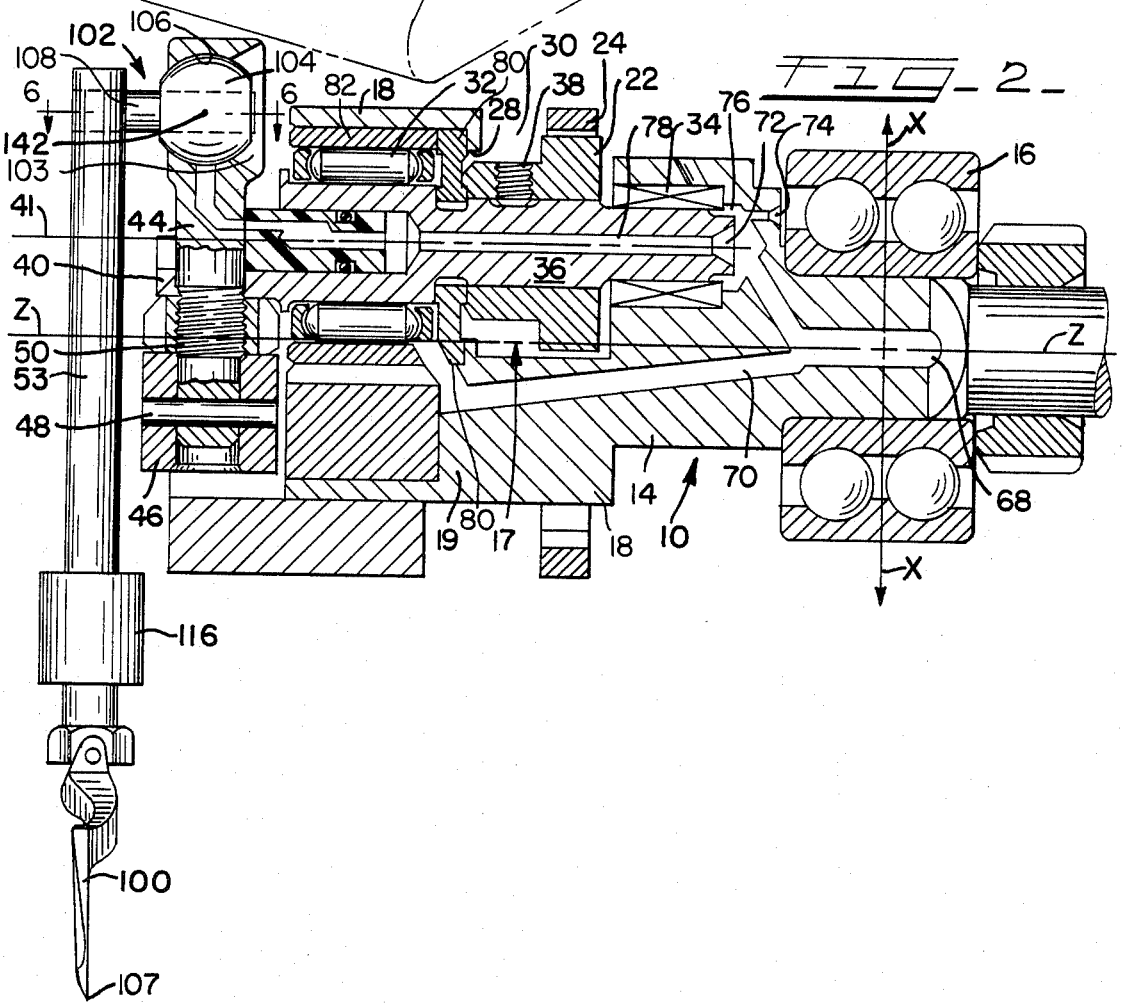
FIG. 2 is a partial view in horizontal section of the looper drive Cardan gear module and looper assembly.
Figures 3, 8, 9:
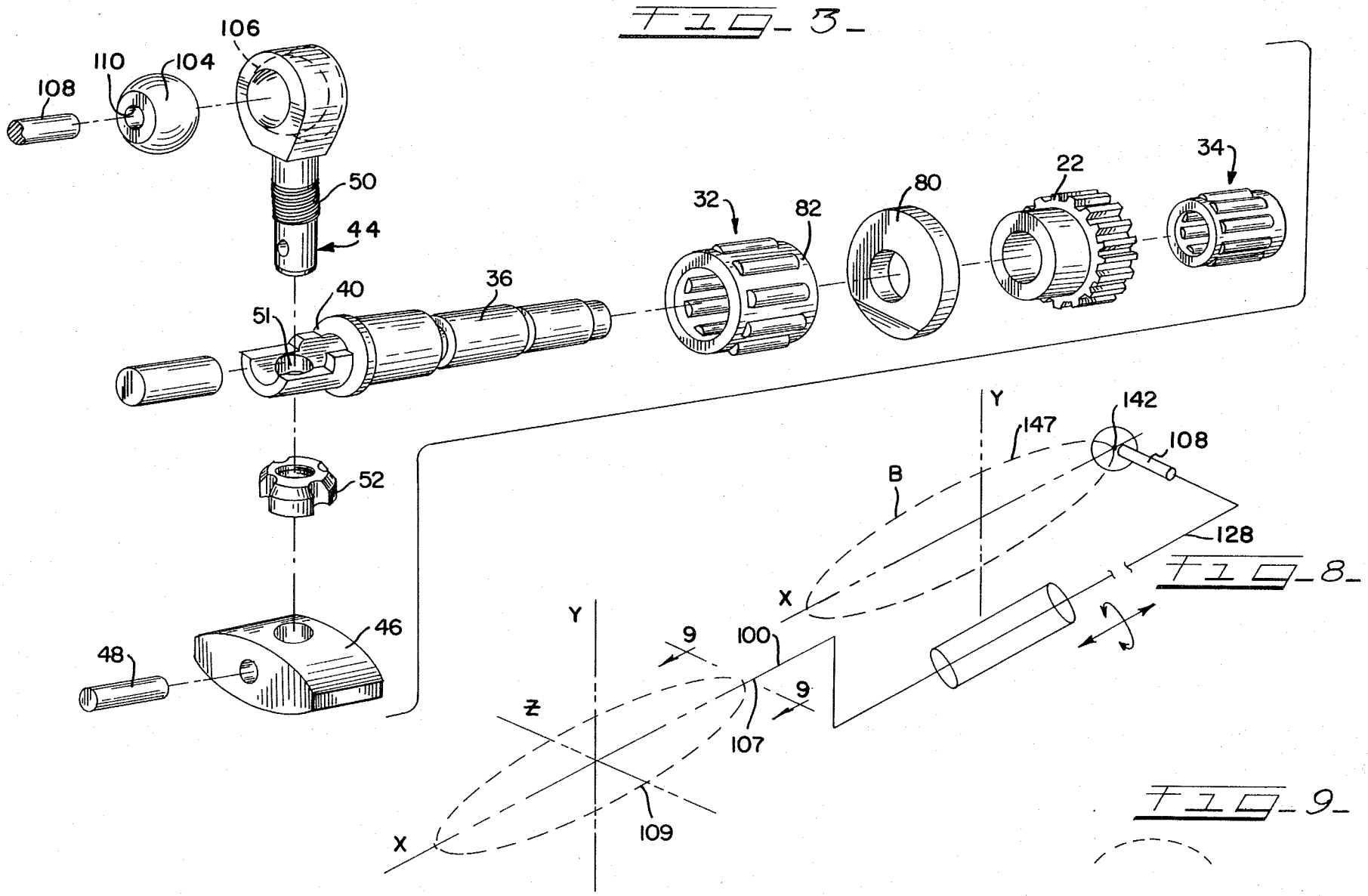
FIG. 3 is an exploded isometric view of the elements carried by and including a double speed bearing.
FIG. 8 is a diagrammatic view showing the path swept out by the center of the output pin and the corresponding path swept out by the tip of the looper.
FIG. 9 is a view taken along line 9—9 of FIG. 8.

Secured generally in a cantilevered manner to the left end portion 19 of the shaft means 14, as shown in FIG. 2, is the Cardan gear assembly or module 10. The module 10 includes an enlarged extension or frame means 18 of shaft 14 supported in cantilever fashion from bearing 16. As shown, this frame means 18 is shaped to receive a pinion gear assembly 17 as shown in FIG. 2 and 3. The extension 18 is provided with a horizontally extending aperture or cavity 28, as well as a cutaway portion 30. As is apparent, the cutaway portion facilitates the engagement of the pinion gear means 22 with the Internal ring gear 24 mounted within the module. The aperture means 28 carries the double speed bearing means which includes first and second bearing sets 32 and 34 which journal the pinion shaft means 36. The ratio between the teeth of the pinion gear means 22 and the internal ring gear 24 is one to two. Consequently, the pinion gear means 22 makes one full rotation as it rolls on the internal ring gear 24 over 360 degrees of the latter. The set screw 38 is employed to secure the pinion gear 22 to the pinion shaft 36. Secured to the left end 40 of the pinion shaft 36 is a lever or connecting means 44 which connects the work performing instrumentality 53 thereto such that overall a cantilevered system is created. The lever means 44 also connects to the pinion shaft 36 a mass 46 which exerts force on said shaft whereby when balanced around line 41 there would be a minimal load vector exerted on the double speed bearing means 32 and 34. In the preferred embodiment the mass exerting the force is a counterweight means 46 which is secured to lever means 44 with a pin means 48. In the preferred embodiment, the lever means 44 is provided with a threaded portion 50 designed for engagement with a spanner nut 52. The lever means 44 is inserted through the aperture means 51 in the shaft means 36 and the spanner nut 52 securely locks the elements in a predetermined position. The lever means 44 adjacent its top portion is provided with an aperture or socket means 106. Positioned within said aperture 106 is a floating element 104 forming a portion of a force transfer means 102.

The work performing means or in the embodiment shown, a looper bar 53, is held in position by bearing set means 116.

Referring to FIG. 2, it is well known that when the output centerpoint (identified by numeral 142) of the Cardan gear is on the pitch diameter of the ring gear 24, the output will be along a straight line path. Thus, no further explanation will be devoted thereto.

The bearing sets hereunder discussion, that is, the main bearing set 16, the double speed bearing sets 32 and 34, and the bearing associated with the force transfer means 102 are all provided with a positive oiling system. Oil enters main channel means 68 under pressure and thereafter passes via auxiliary channeling to each of the respective bearing sets. Bearing set 32 receives oil via channel means 70, bearing set 16 via channel means 72 and 74, bearing set means 34 via 72 and 76 and force transfer means 102 via channel means 72 and 78. Any suitable oil pumping system can be employed as is presently employed in conjunction with industrial sewing machines.

The pinion shaft 36 is secured in place by the provision of a thrust washer 80. A combination of the outer race 82 of the bearing set 32 on one side and the frame means 18 on the other secure thrust washer 80. In the preferred embodiment the thrust washer 80 is a material manufactured by the DuPont Corporation under the trade name "Vespel". The thrust washer 80 provides a substantially friction free abutting surface for the pinion gear 22 whereby the pinion shaft and related assemblies are fixed with regard to the frame assembly.

Figure 4:
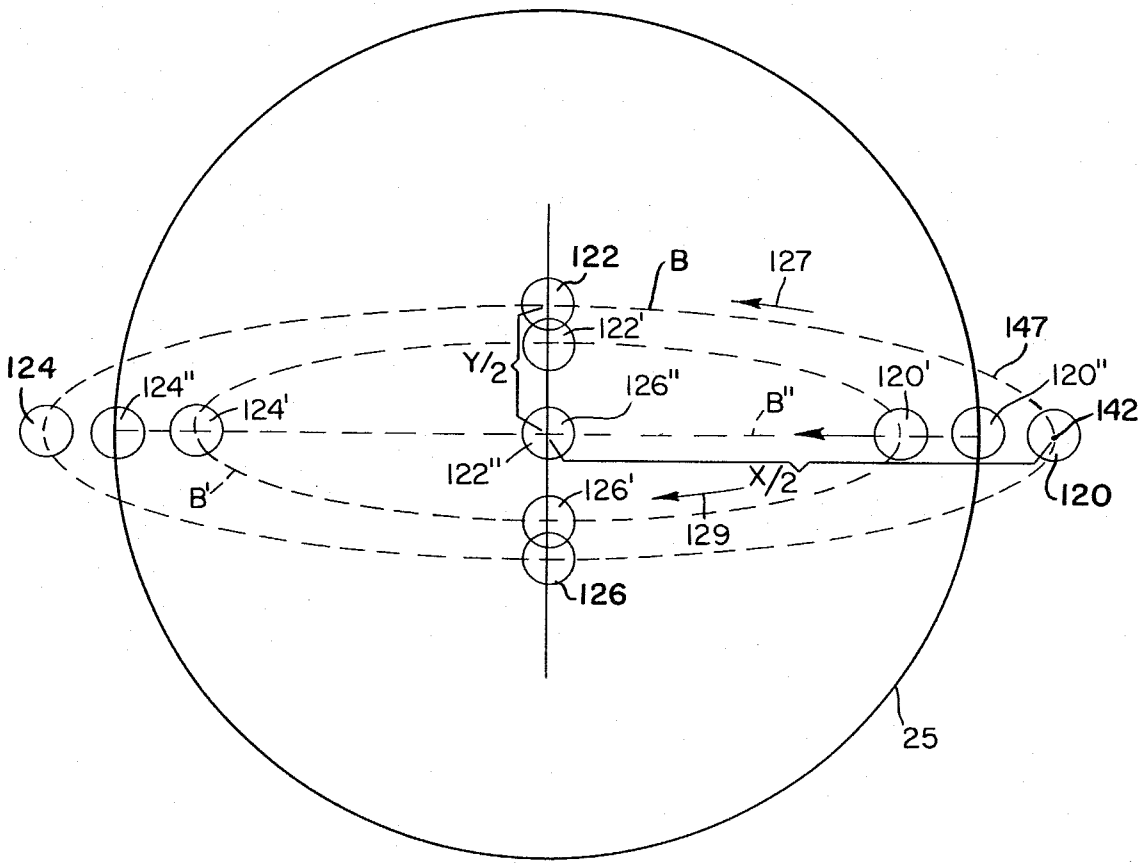
FIG. 4 is a diagrammatic view showing the path of movement of the center of the output pin as it is positioned at different points with respect to the ring gear.

Referring again to FIG. 2 wherein is shown the basic Cardan gear module 10. The force transfer or full floating bearing means 102 is carried at the output end of the lever means 44. In the preferred embodiment, the force transfer means 102 includes a floating element or ball means 104 that is substantially closed within a socket 106 provided on the free end of lever means 44, and a journal or slider pin 108 positioned in an aperture 110. The rear portion 103 of the socket means 106 being broken away to allow movement of the pin 108. The force transfer means 102 in this particular orientation, corresponds to position 120 as shown in FIG. 4. In this position, the output centerpoint means 142 of the ball means 102 will sweep out an ellipse corresponding to B as shown in FIG. 4. The ellipse B in FIG. 4 corresponds to the ellipse B in FIG. 8.

The output centerpoint 142 in the particular embodiment here under consideration is moving along the planer or two dimensional elliptical path 147 shown in FIG. 4 and 8. During this time the pinion gear 22 is being driven, via the main drive shaft 14, such that, due to the engagement with the ring gear 24 it is caused to spin around center line 41. As described below, this well known situation exists in Cardan gear mechanisms whenever the output centerpoint is moved off the pitch diameter of the ring gear.

Fixedly connected to the pinion shaft 36 for movement therewith is lever means 44. At its free end, and formed as a part thereof, the lever means 44 is provided with the socket means 106 which accomodates the ball element 104 of the force transfer means 102. As the pinion gear 22 rotates, the lever 44 rotates 360° relative to the axis 41 for every full cycle or rotation of the Cardan gear mechanism. Thus, the output centerpoint 142 of the force transfer means 102 moves along a planar elliptical path. Because the socket means is formed as part of the lever means 44, any point on the socket means 106 rotates, along with the lever 44, in a full 360° circle around the centerpoint 142 as well as moved along the elliptical path.

A portion of the force transfer means 102, the output centerpoint 142 thus moves along a planer elliptical path while the socket 106 is rotated around the output center point 142 and simultaneously moved along the planer elliptical path. In order to generate the desired motion of the looper bar means 53 only the planer elliptical path generated by the output centerpoint 142 is employable. Herein lies a function of the force transfer means 102, to take motion rotating around a point while moving along an elliptical path, and transfer it into two dimensional motion, that reciprocating and rotating motion along and around a straight line.

The major axis of said ellipse and said straight line being parallel and spaced apart.

Another function of the force transfer means 102 is to take motion rotating around a point, while moving along a straight line, and transfer it into three dimensional motion, that is reciprocating and oscillating motion along and about a straight line. Said straight lines being in spaced apart parallel planes but having their major axis skewed with respect to each other. This arrangement being employed in copending patent application Ser. No. 904,204, filed May 9, 1978, now U.S. Pat. No. 4,344,376.

In either case the force transfer means subtracts the unwanted motion rotating around a point from the total motion involved and allows the transmission of the remainder.

Referring to FIG. 3, it is apparent that the force transfer means 102 has at least two bearing surfaces. The first bearing surface of the force transfer means is that of the outer surface of the ball 104 which engages the bearing surface of the socket 106 provided on lever means 44. The second bearing surface of the force transfer means is that of the outer surface of slider pin 108 in engagement with aperture 110.

With either type of system the stroke of the output centerpoint 142 whether a straight line or the major axis of an ellipse, will correspond to the stroke of the looper bar or work performing means. The minor axis and/or the degree of skew are the components which contribute the oscillating motion.

FIG. 4 depicts various output motions of the output centerpoint 142 depending on its orientation relative to the pitch diameter 25 of the Cardan ring gear. As is known, when the Cardan gear mechanism is activated and the output centerpoint 142 is located outside the pitch diameter 25 of the ring gear, as shown at position 120 in FIG. 4, the output centerpoint will travel in the direction of arrow 127 and will trace out an ellipse shown as B. When the output centerpoint 142 is located inside the pitch diameter of the ring gear, as shown at position 120', the output centerpoint will travel in the direction of arrow 129 and will trace out an ellipse shown as B'. Alternatively, if the output centerpoint is located on the pitch diameter 25 of the ring gear as shown at position 120'', the output centerpoint will traverse a generally straight line path illustrated as B''. The remaining reference numerals 122, 124 and 126, as well as their corresponding primes, depict various positions of the output centerpoint, depending on its orientation relative to the pitch diameter of the ring gear, during rotation of the Cardan gear mechanism.

Figure 5:
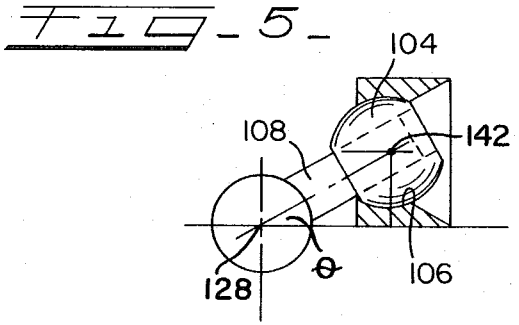
FIGS. 5, 6 and 7 are partial views showing the relationship of the output assembly and the looper bar at different points of the work cycle.
Figure 6:
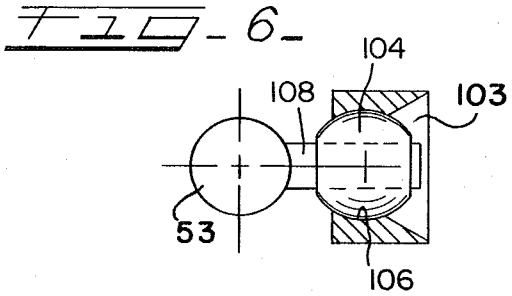

At the beginning of a work cycle, corresponding to point 120 in FIG. 4, the relationship of the lever means 44, the force transfer means 102 and the shaft 53 corresponds to that shown in FIG. 6. The position identified as 122 in FIG. 4 corresponds to the particular orientation of the looper bar 53, force transfer means 102 and lever means 44 as shown in FIG. 5. As is apparent the output center means 142 of the ball means is sweeping out an ellipse having a minor axis of Y and a major axis of X. The movement of the output centerpoint from position 120 to position 122 causes the looper bar means 53 to be moved through a stroke corresponding to X/2 while being rotated around its major axis an amount corresponding to an angle theta. The angle theta being generated when the output centerpoint 142 of ball means 104 moves the distance Y/2.

Figure 7:
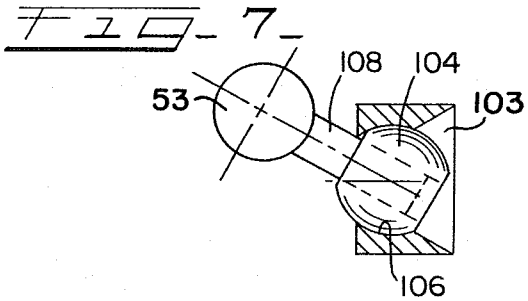

As this movement is taking place it is apparent that the slider pin 108 has moved in relation to the ball means 104. This is necessary to allow movement between the elements, since the looper bar 53 is fixed with respect to the Cardan gear of module 10 and is reciprocating along its major axis corresponding to the line 128 as shown in FIG. 8. The tip 107 of looper 100 passing through the curve 109, an end view being shown in FIG. 9. The relationship of the force transfer means to the looper bar means 53 and the lever means 44 as shown in FIG. 6 correspond to that position 124 shown in FIG. 4. As is apparent the relative relationship of position 124 is the same as that shown in 120. The same is true of FIGS. 7 and 5 these corresponding to positions 126 and 122. The angle theta corresponding to the degrees of rotation of looper shaft 53 is the same in FIGS. 5 and 7, and is a factor of Y.

The forces on the full floating bearing means 102 will be at a maximum generally in locations 120 and 124 as shown in FIG. 4. The locations 122 and 126 will correspond generally to positions of minimum load. As is apparent forces are concentrated on one side of the full floating bearing as it accelerates from position 120, in the position of 122 deacceleration begins and while forces are at a minimum, the forces will be concentrated at a location opposite to that during acceleration. These accelerations and deaccelerations correspond to the stroke of the sewing machine during a work cycle.

The force transfer means as disclosed allows force to be transferred from the lever means 44 to the work performing instrumentality 53. That is, it converts planer motion input into spatial or three dimensional motion output. In the preferred embodiment disclosed, the round pin 108 journals the aperture 110 in the ball means 104 which allows for greater distribution of the loads. Additionally, the force being transferred can be distributed across two bearing surfaces for the maximum amount of freedom. Substantial freedom is thus allowed for transferring the force and direction of the output lever 44 to the work performing means 53. This is accomplished with the minimum number of restrains such that both the translational as well as rotational movement can be imparted to, in the preferred embodiment, a looper bar. As shown herein the force transfer means 102 is employed in the production of an elliptical output referred to in copending patent application, now U.S. Pat. No. 4,344,376.

The utility of this invention is more fully explained in other copending U.S. patent applications. For example application Ser. No. 904,206 filed May 9, 1978, now U.S. Pat. No. 4,374,502 discloses output which is along a helical path; application Ser. No. 904,207, filed May 9, 1978, now U.S. Pat. No. 4,362,113 discloses a device which generates output along a helical/elliptical like path; application Ser. No. 478,599, filed Mar. 24, 1983, now abandoned discloses a balanced Cardan gear module; and application Ser. No. 904,205 filed May 9, 1978 discloses a modularized sewing machine incorporating a series of Cardan gear module output devices.

While a preferred embodiment of the invention has been described and shown in some detail it will be understood that various changes may be made in the construction and arrangement of parts without departing from the invention as defined by the appended claims.

What is claimed:

1. A sewing machine having looper means, a Cardan gear means including a ring gear, a pinion gear operatively associated with said ring gear, and a lever means that is connected to said pinion gear and adapted for circular swinging movement about the central axis of said pinion gear with the output point of the Cardan gear means being located on said lever means wherein the improvement comprises:

force transfer means drivingly connecting the Cardan gear means and the looper means of the machine, said force transfer means being connected to said lever means and having a bearing surface engaging another bearing surface provided on said lever means whereby permitting only oscillatory and reciprocatory movement to be imparted to said looper means.

2. The improvement of claim 1 wherein said force transfer means includes a journal means and floating element means.

3. The improvement of claim 1 wherein said floating element means is a ball element means that is substantially closed within a socket provided on said lever means.

4. The improvement of claim 2 wherein said journal means is a slider pin means formed as an integral portion of a bar carrying said looper means.

5. A sewing machine having in combination looper means, a Cardan gear mechanism means having an output centerpoint movable in two dimensions, a ring gear, a pinion gear operatively associated with said ring gear and a lever means arranged for circular swinging movement about the center axis of the pinion gear with said output centerpoint being located thereon, wherein the improvement comprises:

means operative for drivingly connecting the Cardan gear mechanism means and said looper means, said means operative being adapted to transmute the movement of the output centerpoint movable in two dimensions to three dimensional movement at the tip of the looper means.

6. The improvement of claim 5 wherein said means operative includes an apertured, substantially spherical element carried within a mating socket provided on said lever means, and slider pin means received within said apertured spherical element and connected to said looper means.

* * * * *